United States Patent [19]

Okahashi et al.

[11] 4,374,311

[45] Feb. 15, 1983

[54] ELECTRICAL MULTILAYER CONTACT

[75] Inventors: Keiji Okahashi; Masanori Motoyama, both of Hirakata; Satoru Furukawa, Kadoma, all of Japan

[73] Assignee: Matsushita Electric Works, Ltd., Osaka, Japan

[21] Appl. No.: 282,711

[22] Filed: Jul. 13, 1981

[30] Foreign Application Priority Data

Jul. 18, 1980 [DE] Fed. Rep. of Germany ..... 3027304

[51] Int. Cl.[3] ..... H01H 1/02

[52] U.S. Cl. ..... 200/269

[58] Field of Search ..... 200/269, 270; 428/671, 428/635

[56] References Cited

U.S. PATENT DOCUMENTS

| | | | |
|---|---|---|---|
| 2,486,341 | 10/1949 | Stumbock | 75/232 |
| 3,576,415 | 4/1971 | Gwyn | 200/269 |

FOREIGN PATENT DOCUMENTS

| | | | |
|---|---|---|---|
| 2259792 | 6/1973 | Fed. Rep. of Germany | 29/195 |
| 2403048 | 7/1975 | Fed. Rep. of Germany . | |
| 2524743 | 12/1975 | Fed. Rep. of Germany | 200/153 M |
| 55-66812 | 5/1980 | Japan | 200/269 |
| 238227 | 6/1945 | Switzerland . | |

*Primary Examiner*—John W. Shepperd
*Assistant Examiner*—Renee Kidorf
*Attorney, Agent, or Firm*—Schwartz, Jeffery, Schwaab, Mack, Blumenthal & Koch

[57] ABSTRACT

An electrical multilayer contact, specifically for relays, comprises the following layers disposed upon each other on a contact support member:

- a first layer of a copper-nickel alloy for mechanically and electrically connecting the further layers to the support member,
- a second layer consisting of silver or having a very high silver content for adhering the further layers to the first layer,
- a third layer of a silver-tin oxide composition,
- a fourth layer of silver or a silver alloy, and
- a fifth layer of gold or an alloy having a high gold content.

This multilayer structure is preferably used for both, the fixed contact member and the movable contact member of a relay contact couple. In this case, the upper surface of the multilayer contact structure disposed on the fixed contact is plane, while that on the movable contact is curved in one direction to cooperate with the opposite plane surface in forming a line contact.

10 Claims, 3 Drawing Figures

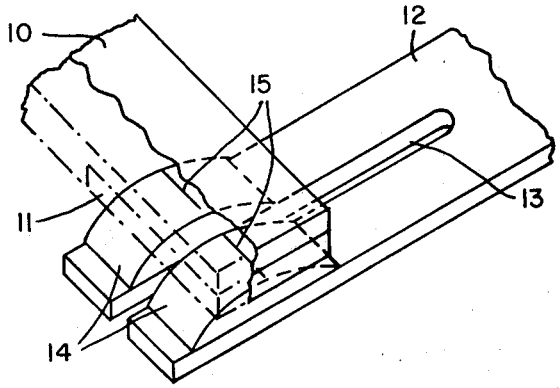
FIG. 1
FIG. 2
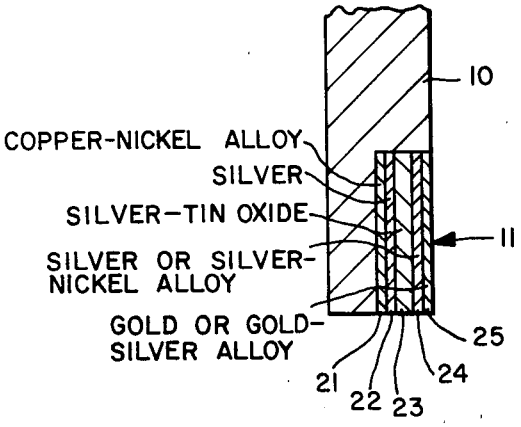
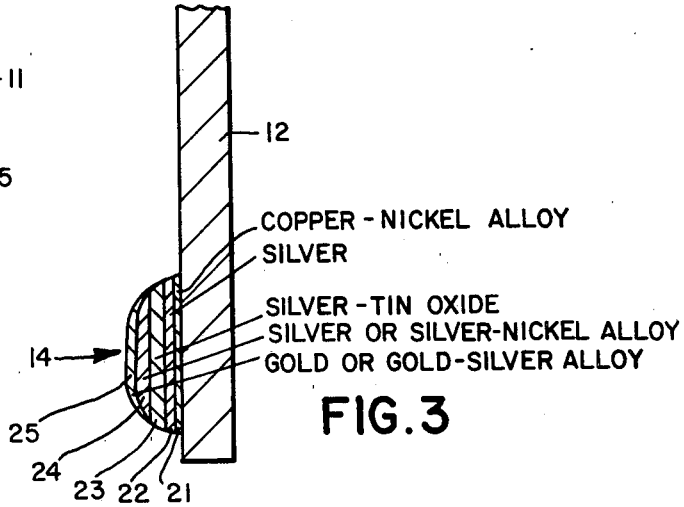
FIG. 3

ELECTRICAL MULTILAYER CONTACT

BACKGROUND OF THE INVENTION

The invention relates to an electrical multilayer contact, particularly for relays.

In the electrical switching, the following load conditions are distinguishable:

| Type of Load | Load Range | Contact Stress |
|---|---|---|
| (a) dry circuits | <80 mV, <10 mA | no softening of thin layers of foreign material |
| (b) low loads | <300 mV, <100 mA | contact area increases by softening |
| (c) medium loads | <12 V, <300 mA | minor melting at the contact position |
| (d) heavy loads | >12 V, >300 mA | burn-off of contact material by arc capacitive or inductive effects |
| (e) a.c. voltage loads | 6–12 V, <5 A | contact burn-off |

A great number of contact materials is available to cope with these largely varying load conditions. For dry loads, for instance, alloys having a high gold content are suitable, such as AuCo 99/1, AuNi 97/3 or AuAg 90/10, since gold is very little corrosive and hardly affected by foreign layer formation. Moreover, since gold is relatively soft, a considerable contact surface is created even by small contact forces, thereby reducing the constriction resistance, which forms part of the contact resistance. Unalloyed gold is even somewhat too soft so that there may be a risk of contact sticking. This may be problematic specifically in relays without positive forced contact opening, such as reed relays. In this case, even mechanical vibrations as occur for instance during the cleaning process in an ultrasonic bath of circuit boards equipped with reed relays, may lead to a cold welding of normally closed contacts. As a counter-measure, the gold contact may be coated with a rhodium layer of a thickness in the Ångström range which, due to its greater hardness, prevents contacts from sticking even when exposed to ultrasonic vibrations. While this measure increases the contact resistance by about 5%, the gold characteristic of the contact is essentially maintained.

In theory, relays may readily be provided with that contact material which is an optimum for any given load condition. However, disregarding those few cases in which relays with a specific contact material are required in large numbers, this is uneconomic, because too many different types would have to be manufactured in relatively small quantities.

For this reason, contacts for a wide load range have been developed. Such bi- or tri-metal contacts are disclosed in the book "Relais Lexikon" by H. Sauer, Deisenhofen 1975, page 49, FIG. 41. These relays comprise two or three layers wherein an about 0.2 mm thick layer of silver or an Ag-Ni alloy is disposed under an about 20 μm thick gold layer. A basis is formed by a Cu-Ni alloy having an even higher burn-off resistance. Dry circuits as well as low, medium and heavy loads may be switched with contacts of this type. For a.c. voltage loads, however, the silver-nickel alloy is not particularly suited.

It is an object of the present invention to provide an electrical multilayer contact which is capable of a reliable switching over the entire range of the above-mentioned load conditions. As a further object, a multilayer contact of this type is to be provided which has a long useful life.

SUMMARY OF THE INVENTION

The electrical multilayer contact of the present invention comprises the following layers disposed upon each other on a contact support member:

- a first layer of a copper-nickel alloy forming a mechanical and electrical connection to said support member,
- a second layer having a very high silver content of up to 100%,
- a third layer of a silver-tin oxide composition,
- a fourth layer of a silver alloy containing up to 100% silver, and
- a fifth layer of a gold alloy containing up to 100% gold.

A multilayer contact is thus achieved which may be used for all switching load conditions from 1 μA to 5 A and from 1 mV to 250 V d.c. or a.c. voltage and up to a maximum switching power of 100 V or 1 kVA. A relay provided with such contact is universally usable. While the fifth, uppermost layer of the contact, which may consist of an alloy containing 90% Au and 10% Ag and have a thickness of about 5 μm, is provided for dry circuits and the fourth layer made of a silver-nickel alloy is provided for low and medium loads, the third layer consisting of a silver-tin oxide composition takes high loads and a.c. voltage loads when the fifth and fourth layers have been removed, for instance burnt off. The second layer serves as an adhesive layer between the third and first layers, and the first layer leads the heat occurring under heavy contact load to the contact support member and additionally serves to maintain the operability of the contact when the upper contact layers have been worn out upon expiry of the normal life.

BRIEF DESCRIPTION OF THE DRAWINGS

FIG. 1 is a perspective view showing a portion of a contact system as may be used in an electromagnetic relay.

FIGS. 2 and 3 are cross-sections of the multilayer contact structures provided on the fixed and movable contact members of the contact system shown in FIG. 1.

DESCRIPTION OF THE PREFERRED EMBODIMENTS

The contact system shown in FIG. 1 includes a fixed contact member 10 having a multilayer contact structure 11 formed at its lower side in the so-called inlay technique, and a movable contact member 12, e.g. a contact spring, having its end divided by a longitudinal slot 13, each of the thus formed end portions carrying a multilayer contact structure 14 formed in the so-called top-lay technique.

While the upper surface of the contact structures 14 is curved in one plane or one direction, the upper surface of the contact structure 11 is plane. When in operation the upper surfaces of the contact structures engage each other, they form a line contact as indicated at 15. Due to the relative softness of the uppermost layers in the structures 11 and 14, and depending on the contact force, the contact will in practice occur over a substantially rectangular area rather than along a mathematical line.

As shown in FIGS. 2 and 3, each of the contact structures 11 and 14 comprises a first layer 21 which is made of a copper-nickel alloy, preferably containing 70% of copper and 30% of nickel and having a thickness of about 0.07 mm, which layer serves as a mechanical and electrical connection between the multilayer contact structure and the contact support member 10 or, respectively, 12.

A second layer 22 which has a silver content of at least 99% and a thickness of about 0.025 mm, forms an adhesive layer between the first layer 21 and the further layers of the multilayer contact structure.

Disposed on the second layer 22 is a third layer 23 made of a silver-tin oxide composition, preferably containing 90.7% of silver and 9.3% of tin oxide and having a thickness of about 0.14 mm.

A fourth layer 24 disposed on the third layer 23 is made of silver or preferably of a silver alloy containing 85% of silver and 15% of nickel and has a thickness of about 0.06 mm.

The upper, fifth layer 25 consists of gold or an alloy having a high gold content, preferably 90% of gold and 10% of silver. The fifth layer 25 has a thickness of about 5 μm.

The fourth layer 24 provided according to the present invention has a greater hardness than the middle silver layer in the known three-layer contact structure and is therefore more suited for low and medium loads, so that the thickness of the layer may be reduced to about $\frac{1}{3}$, yet achieving the same useful life.

The material of the third layer 23 is a contact material particularly suited for heavy loads and a.c. voltage loads and is essentially more wear resistant for these types of load conditions than silver-nickel alloys. The third layer becomes effective as soon as the fifth and fourth layers have been worn off by contact loads which are too high for the contact materials provided in these layers. For switching dry circuits, low or medium loads, this third layer would be less suitable. In the present case, however, this is of no concern because the fifth and fourth layers are provided for these conditions. The thickness of the third layer 23 is selected such that the useful life to be expected is achieved under heavy load.

Due to its high silver content, the second layer 22 provides a safe connection between the third $AgSnO_2$ layer 23 and the first CuNi layer 21 forming the basis of the contact. Such a safe connection could not be guaranteed without the second layer 22.

The CuNi alloy selected for the first layer 21 provides a good electrical and mechanical connection between the contact support member 10, 12 and the multilayer contact structure, thus an efficient removal of heat from the contact. Since this alloy does not contain precious metals, the overall multilayer contact structure may be economically produced.

As described above, the surface of the multilayer contact structure 14 on the movable contact member 12 is curved in one plane, thereby providing a substantially part-cylindrical contact surface. The curvature is made so that the line of contact with the opposite fixed contact extends vertically to the longitudinal direction of the movable contact member 12. This contact system has, with respect to its fifth layer 25, the 5 μm thick Au90-Ag10 layer, a wear resistivity which is about 5 times that of a point contact, such as a rivet contact, having the same precious metal coating. As a consequence, the contact according to the present invention is still capable of switching dry circuits even upon $10^5$ actuations under heavy load of 2 A, 15 V.

The double-line contact provides small and constant contact resistances and also a relatively constant contact spacing during a long life, due to the fact that contact burn-off or contact wear is less effective in the direction of contact actuation than with a point contact. Moreover, a high short-circuit resistance of about 100 Å over a period of 1 ms, thus high contact reliability, is achieved with the contact of the present invention.

We claim:

1. An electrical multilayer contact, comprising the following layers disposed upon each other on a contact support member:

a first layer of a copper-nickel alloy forming a mechanical and electrical connection to said support member, a second layer having a very high silver content of up to 100%, a third layer of a silver-tin oxide composition, a fourth layer of a silver alloy containing up to a 100% silver, and a fifth layer of a gold alloy containing up to 100% gold.

2. The contact of claim 1, wherein said fourth layer contains 85% silver and 15% nickel and has a thickness of about 0.06 mm.

3. The contact of claim 1, wherein said third layer contains 90.7% silver and 9.3% tin oxide.

4. The contact of claim 1, wherein said third layer has a thickness of about 0.14 mm.

5. The contact of claim 1, wherein said second layer has a silver content of at least 99%.

6. The contact of claim 1, wherein said second layer has a thickness of about 0.025 mm.

7. The contact of claim 1, wherein said first layer contains 70% copper and 30% nickel and has a thickness of about 0.07 mm.

8. A contact system comprising a fixed contact member and a movable contact member cooperating with said fixed contact member, wherein either one of said fixed and movable contact members comprises the multilayer contact structure defined in claim 1.

9. The contact system of claim 8, wherein the multilayer contact structure provided on said fixed contact member has a plane upper surface and the multilayer contact structure provided on said movable contact member has an upper surface curved in one plane so that the upper surfaces of both contact members cooperate to form a line contact.

10. The contact system of claim 8, wherein said movable contact member is provided with a longitudinal slot at its end carrying said multilayer contact structure, to form a double contact.

* * * * *

UNITED STATES PATENT AND TRADEMARK OFFICE

CERTIFICATE OF CORRECTION

PATENT NO. : 4,374,311

DATED : February 15, 1983

INVENTOR(S) : Keiji Okahashi et al.

It is certified that error appears in the above-identified patent and that said Letters Patent is hereby corrected as shown below:

On the title page, assignee should read

-- Matsushita Electric Works, Ltd., and SDS Elektro GmbH, Deisenhofen, Federal Republic of Germany --.

Signed and Sealed this

*Seventh* Day of *June 1983*

[SEAL]

*Attest:*

DONALD J. QUIGG

*Attesting Officer*

*Acting Commissioner of Patents and Trademarks*